US005814749A

United States Patent [19]

Sui et al.

[11] Patent Number: 5,814,749

[45] Date of Patent: Sep. 29, 1998

[54] MOTION PRODUCING NECHANISM FOR MUSIC TOY

[76] Inventors: Aocheng Sui; Xiangdong Chen, both of East Baihe Road, Wu Xing Bridge, Choyzhou Jiang Su, China

[21] Appl. No.: 794,928

[22] Filed: Feb. 4, 1997

[51] Int. Cl.[6] ..... G10F 01/06

[52] U.S. Cl. ..... 84/600; 84/94.2; 84/95.2

[58] Field of Search ..... 84/600–602, 94.2, 84/95.2; 446/265, 298; 40/415, 455

[56] References Cited

U.S. PATENT DOCUMENTS 5,430,238 7/1995 Chen ..... 84/95.2

5,495,151 2/1996 Lu ..... 318/4

*Primary Examiner*—John W. Cabeca

*Assistant Examiner*—Marlon T. Fletcher

[57] ABSTRACT

The invention is a music box which includes a power supply, a motor, gears coupled with the motor, conductors connecting the power supply and the motor, and a music-producing element. At least one platform element is supported atop the housing for pivoting motion about a horizontal axis. Each platform element will support a figurine, character or other object. A linking assembly couples the gears with each platform element. The linking assembly is constrained for substantially linear, reciprocating, motion in a horizontal plane. A rotary output shaft bears a disk having a pin arranged eccentrically thereon. The pin is engagable with one portion of the linking assembly for driving the latter in the linear motion. Each platform element has a depending portion engaging a second portion of the linking assembly so that the linear motion of the linking assembly pushes and pulls the depending element back and forth thereby imparting a rocking motion to the platform means, and hence the figurine mounted atop said platform means.

16 Claims, 4 Drawing Sheets

MOTION PRODUCING NECHANISM FOR MUSIC TOY

BACKGROUND OF THE INVENTION

1. Field of the Invention

The present invention relates to music toys and boxes, and more particularly to drive mechanisms located inside music box housings for imparting pivoting or swaying movements to figurines, characters or other objects supported on pivotable platforms extending outwardly of the housing.

2. Description of the Related Art

Music boxes that have movable figures, characters or objects on top of a housing are well known in the art. Typically, the music is generated by a drum and comb structure, where the drum has pins extending from the exterior in a predetermined arrangement, and the comb is positioned atop the pins of the drum. The drum is rotatable on its axis, and the teeth of the comb are plucked by the interaction of one or more teeth with one or more of the pins extending from the rotating drum. Generally, the drum is set in rotation by a set of gears and motor, either mechanical or electrical.

Typically, the motion of the figures, characters or objects is provided by a transmission arrangement which converts the rotational output of the gears to another form of motion, and the transmission arrangement is then coupled to the figures, characters or objects. The transmission arrangement is capable of imparting rotating, swinging, or reciprocating linear movements to the figures, characters or objects, or combinations of such movements. Examples of transmission arrangements which provide these movements are disclosed by U.S. Pat. No. 2,840,949 to Faulkner, U.S. Pat. No. 4,573,939 to Hoshino, U.S. Pat. No. 4,824,416 to Chun, U.S. Pat. No. 5,226,845 to Wu, U.S. Pat. No. 5,424,485 Hsu, U.S. Pat. Nos. 5,459,278 to Hsu, and 5,525,747 to Hsu et al.

OBJECTS AND SUMMARY OF THE INVENTION

The current invention is a music box that includes a transmission arrangement for converting the rotary motion of a gear output shaft first to linear reciprocatory motion, and then to pivoting motion of a support on which a figurine is mounted.

It is therefore an object of the present invention to provide a novel transmission arrangement for efficiently converting rotational movement of a gear set to pivoting motion of a support without all the linkages and camming devices used by prior art music boxes.

This object, and others which will become more readily apparent upon a closer reading of this disclosure, are achieved by the transmission arrangement of the present invention which includes a gear set driven by a motor, a rotating output shaft connected to the gear set, a lever arm connected between the rotating output shaft and a plate element constrained for reciprocating linear motion. The output shaft of the gear set has a plate mounted on the end transversely of the shaft axis. A pin mounted eccentrically on the plate is secured to a first end of the lever arm. The second end of the lever arm is connected to the plate element, which in turn is connected to at least one pivoting support.

As the plate rotates, the second end of the lever arm, and hence the plate element, is driven with a substantially linear, reciprocating, motion, with the result being that the pivoting support is given alternating pushing and pulling motions. This motion continues as long as the "on-off" switch is in a position where power continues to be supplied to the motor. Thus, the figurine or other object mounted on the top of the pivoting support also pivots, or "sways", back and forth.

DETAILED DESCRIPTION OF THE INVENTION

Figure 1:
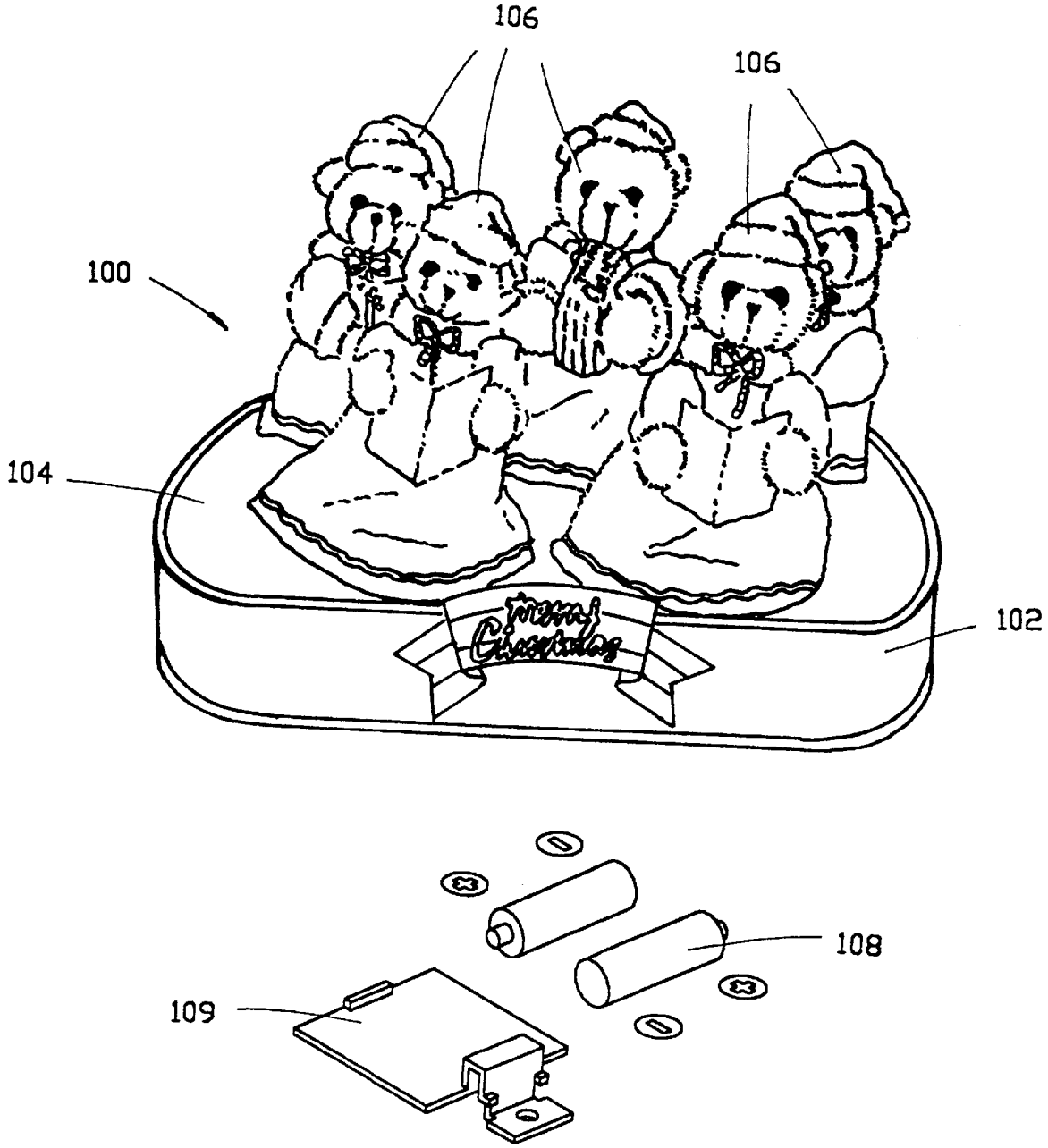
FIG. 1 is an exploded perspective view of the music box according to the present invention.

Referring now to FIG. 1, the music box 100 is shown in perspective view, and is seen to include a housing 102 including a cover plate 104 and figurines 106 supported above the cover plate (the manner of which will be described in greater detail below). Openings 132 (shown in FIG. 2) are provided in the cover plate 104. An opening 133 just to one side of the speaker 114 helps to constrain movement of a slide plate 120 to essentially side to side movement, i.e., between a first side S1 of the cover plate 104 and a second side S2. The length of the slot or opening 133 determines the amount of side to side movement of the slide plate 120. FIG. 1 also shows a power supply assembly 20 which is secured to the underside of the cover plate, and which includes batteries 108 and a battery cover plate 109 that is either detachably secured in place over the batteries in a manner well known in this technology or hinged to the cover plate and configured for latching engagement with a correspondingly configured element on the cover plate. Alternatively, power can be supplied to the music box from an outside power source. A base plate (not shown) is preferably provided to cover the bottom of the music box.

Figure 2:
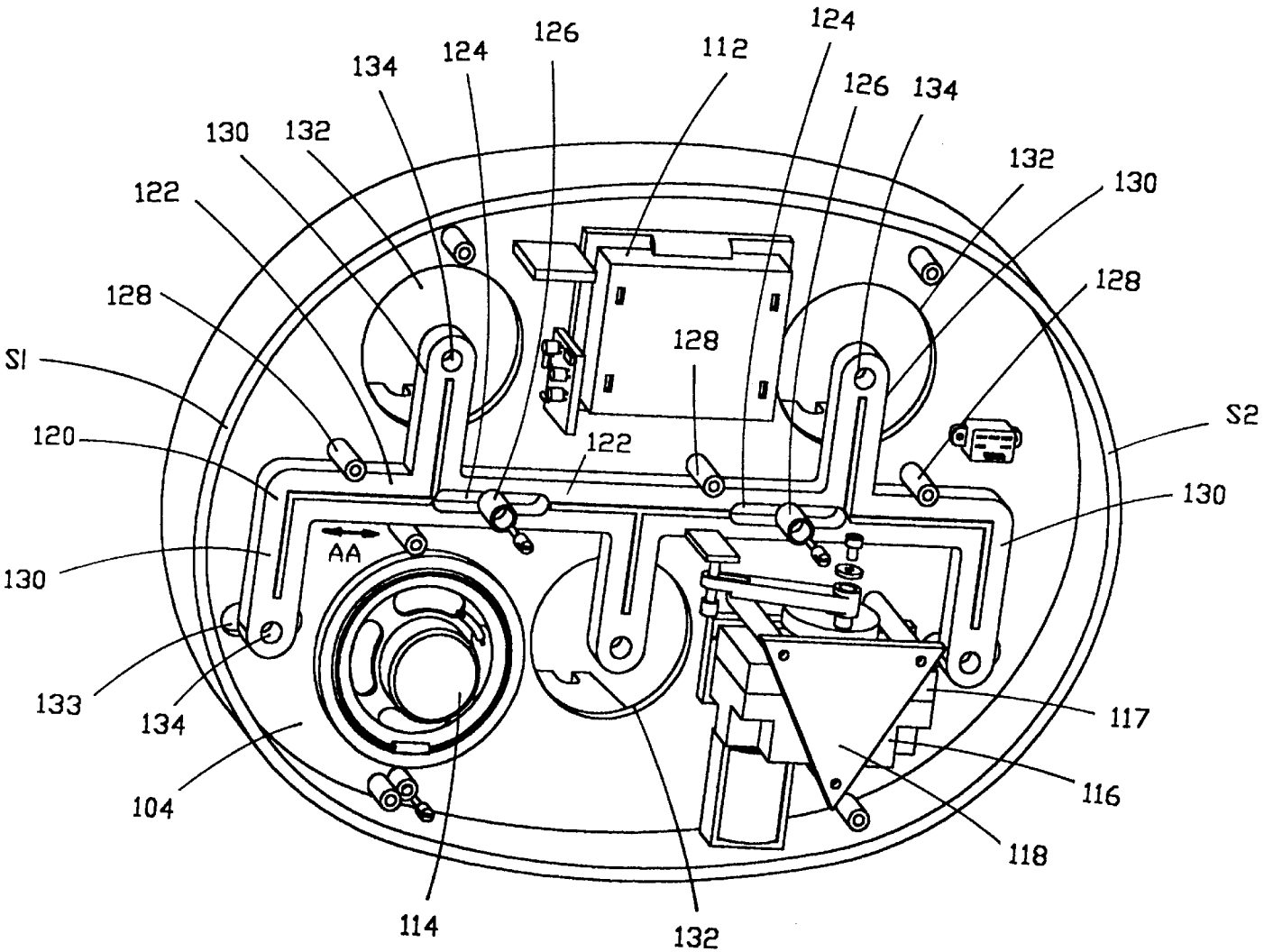
FIG. 2 is a view of the rear side of the cover plate of the music box shown in FIG. 1.

FIG. 2 is a view of the rear or underside of the cover plate showing various components that are housed within the music box 100 and mounted on or otherwise attached to the cover plate 104 These components include a printed circuit board (PCB) 111, a music-generating component 112 mounted on the PCB, a power supply 113, one or more speakers 114, a power "on-off" switch 115 (the actuator of which is located on the opposite side of the cover plate and is accessible to a user), a motor assembly 116, and a gear box holder 118 for keeping the gear box portion 117 of the motor assembly in a fixed predetermined location on the cover plate.

Also supported on the same, rear, side of the cover plate 104 is the slide plate 120. The slide plate includes an elongated body portion 122 defining a longitudinal axis, and at least two axially elongated openings or slots 124 arranged in spaced axial relationship on the slide plate. The slots have a width which will accept fasteners 126 that are secured in appropriately configured apertures in the cover plate 104. Guide pins 128 are linearly arranged with one or both sides of the elongated body portion of the slide plate engaging the pins. The fasteners 126 maintain the slide plate in close parallel proximity with the cover plate, but do not prevent the slide plate from moving axially.

The guide pins 128 constrain movement of the slide plate to a substantially linear direction (as indicated by the double-headed arrow AA. The axial lengths of the openings 124 and 133 define and limit the amount of side-to-side movement that slide plate 120 experiences in the substantially linear direction.

Slide plate 120 includes arms 130 that extend laterally from, and perpendicular to, the body portion 122 of the slide plate. Preferably, the number of arms 130 is equal to the number of openings 132 formed in the cover plate. However, the invention also contemplates fewer arms than openings in a music box construction where not all the figurines, characters or objects 106 seen in FIG. 1 are movable.

Each arm 130 projects from one side of, and into, a respective opening 132 toward the other side of that opening. Preferably, each arm extends into the opening 132 a distance greater than one-half the diameter of the opening so that each support surface 304 of a platform element 302 (see the discussion below in connection with FIGS. 4–6) assumes an initial canted or tilted orientation before the "on-off" switch is actuated to begin the swaying motion of the figurines, characters or objects mounted on the platform surfaces, and so that the swaying motion, once begun, is accentuated. An aperture 134, formed in the free end region of each arm 130, is provided for receiving and securing a pin portion 340 (shown in FIG. 4) formed on a platform assembly 300 (described in further detail below).

Figure 3:
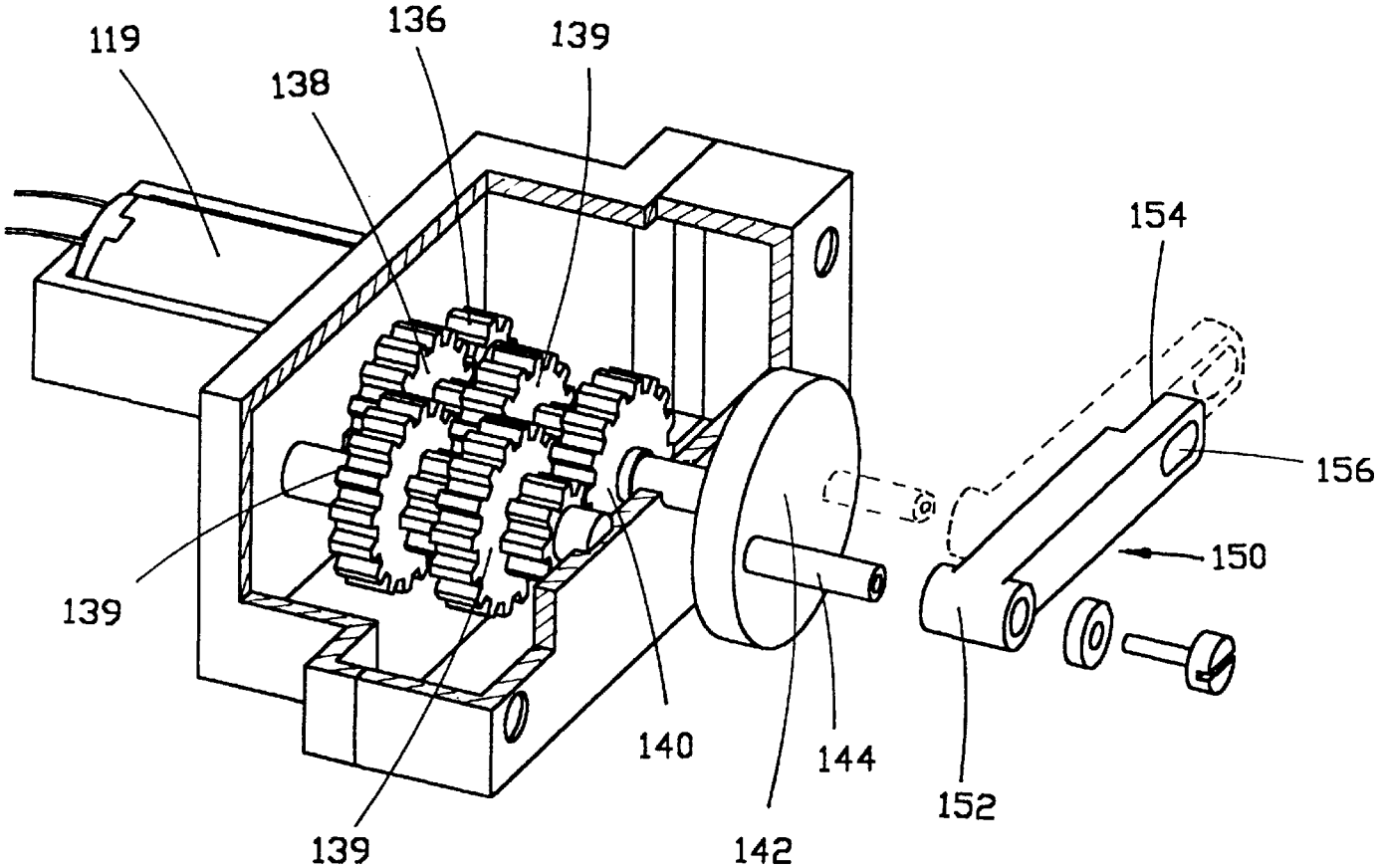
FIG. 3 is a view of the gear set and motor assembly.

FIG. 3 shows the gear and motor assembly 116 mentioned in connection with the apparatus disclosed in FIG. 2. This assembly includes a gear box 117 and a motor 119. The motor, which can be of a common, conventional design, is to be powered by the power source 112.

The motor includes a rotating output shaft 136 bearing gear teeth that engage with gear teeth on a first gear 138 of a gear set in the gear box. The gear set includes two parallel shafts on which are mounted various complementary gears 139 designed to reduce the speed of the output shaft 136 to a predetermined speed, the purpose of which will be described below in conduction with the pivoting platform shown in FIG. 4. Associated with an "output" gear 140 carried on one of the shafts is a plate or disk 142. A pin 144 is eccentrically secured to the plate 142 at a location nearer the circumference of the plate than the center of the plate. One end 152 of a link arm 150 is attached to the pin 144 by appropriate fastener means. The opposite end 154 of the arm includes a slot 156 which is adapted to be connected to the platform assembly 300 on which the figurines are mounted (see the description below).

Figure 5:
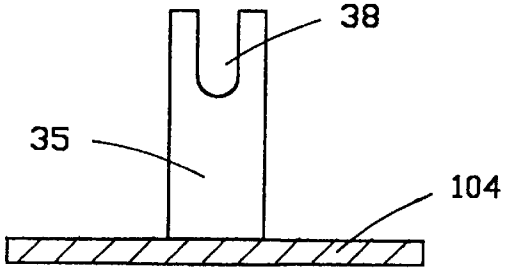
FIG. 5 is a side view of the pivoting support shown in FIG. 4.
Figure 6:
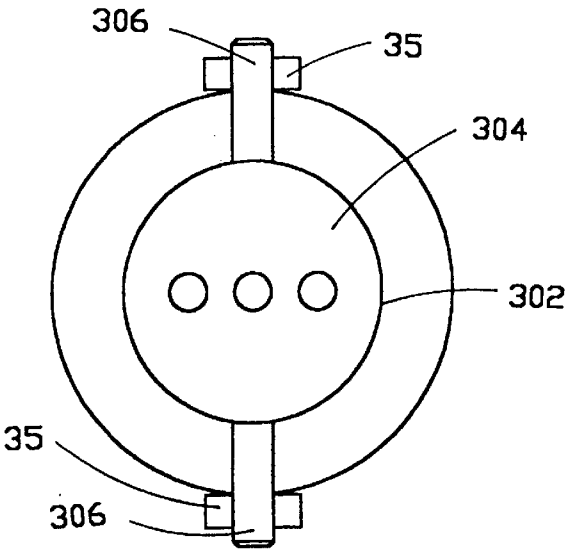
FIG. 6 is a top view of the pivoting support shown in FIG. 4.
Figure 4:
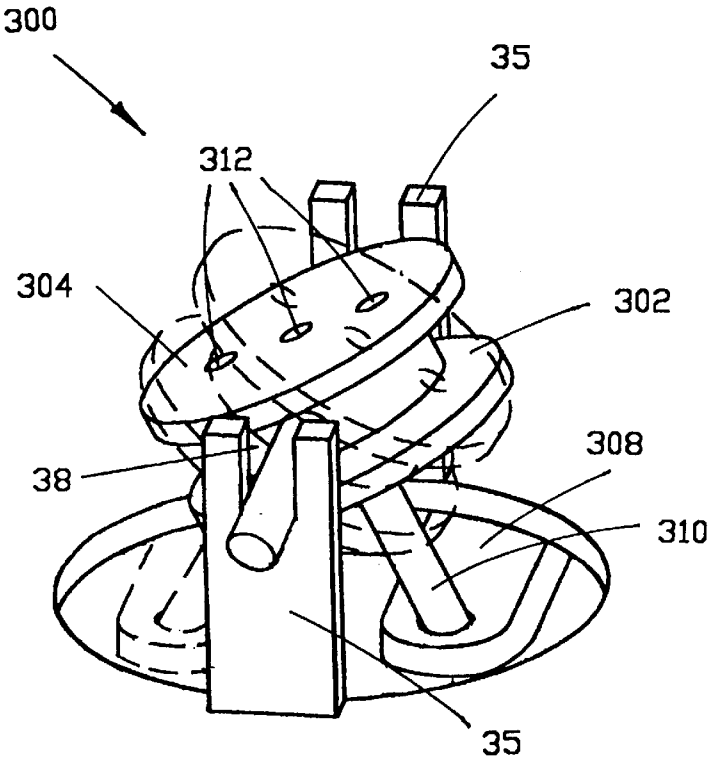
FIG. 4 is a view of one pivoting support for a figurine, character or object supported on the upper side of the music box shown in FIG. 1.

Referring now to FIGS. 4–6, there is shown a platform assembly 300 mounted for pivoting or rocking motion on the cover plate 104 of the music box 100 of the present invention. The platform assembly 300 includes a platform element 302 on which the figurines, characters or objects 106 are to be mounted (mounting of these elements can be effected in any manner that is well recognized and known in this art). Each platform element is configured as a disk having a support surface 304, and a pair of radially extensive arms 306, preferably diametrically arranged, extending outwardly from the disk. A connection member 308 projects away from the disk on the side of the disk opposite the support surface. The connection member includes a pin element 310 designed for engagement in the aperture 134 of the slide plate 120. Preferably, the pin element is affixed in the aperture by a friction fit or by an appropriate fastener connection. A pair of support arms 35, 35, preferably of resilient material, are located on the circumference of each aperture 132, and project from the outer or forward surface of the cover plate in a direction away from the components secured to the rear of the cover plate. Each arm includes an opening 38, 38 configured for receiving one arm 306 of a respective platform element. The engagement of the pair of platform arms 306 in the cover plate arms 35, 35 allows the support platform to pivot or rock about the arms 306 so that figurines, characters or objects secured on the surface 304 (typically, these figurines, characters or objects will be secured with wire or fasteners secured in the openings 312 shown in FIG. 4) of the platform will appear to be swaying from side to side.

The speed of swaying or tilting of the figurines, characters or objects mounted on the support platform can be controlled by choosing an appropriate set of speed reduction gear ratios. One or more noise reduction gears can be included in the gear set. The motion imparted to the figurines, characters or objects mounted on the support platforms is caused by the movement of the slide plate 120 from side to side, which is transferred, via the connection of the pin element 310 with the aperture 134 in the slide plate, to the support platform.

The present invention contemplates that sound production or reproduction apparatus will be included in the music box. The music or other sound is generated by an IC chip 60 mounted on the printed circuit board 111 on the rear of the cover plate 104. The switch 115 can have several settings, including "music on", "music off", "motor on" and "motor off". The motor, IC, and speakers are all connected with the power supply by appropriate conductors 80 connected with the printed circuit board 111.

While the present invention has been described in conjunction with specific embodiments thereof, it is evident that many alternatives, modifications, and variations will be apparent to those skilled in the art in light of the foregoing description. Accordingly, the present invention is intended to embrace all alternatives, modifications, and variations which fall within the spirit and scope of the appended claims.

What we claim is:

1. A music box, comprising:

a housing including a motor, gear apparatus coupled with said motor and defining an output axis, at least one platform means having a portion for supporting a figurine, said platform means being supported by said housing for pivoting motion about a horizontal axis, the horizontal axis and said output axis being arranged parallel to one another, and linkage means coupling said gear apparatus and said at least one platform means, said linkage means including a first rigid element interconnecting said gear apparatus with a second rigid element, where said second rigid element is coupled with each said platform means, said linkage means being constrained for substantially linear, reciprocating, motion.

2. The music box of claim 1, wherein said gear apparatus includes a rotary output shaft coincident with said output axis, a disk carried by said output shaft, and a pin arranged eccentrically on said disk and engagable with said first rigid element for driving said second rigid element in said substantially linear motion.

3. The music box of claim 1, wherein said platform means includes a portion depending into said housing for engagement with said second rigid element of said linkage means so that reciprocating linear movement of said second rigid element imparts a pushing and pulling action to said platform means to cause the latter to experience a swaying motion.

4. The music box of claim 3, wherein said housing further includes music producing means, and means for synchronizing said swaying motion of said platform means with music from said music producing means.

5. The music box of claim 1, wherein said portion of said platform means for supporting a figurine is located outside of said housing.

6. The apparatus of claim 1, wherein said first rigid element comprises a body portion extending from said output axis toward said second rigid element, and said second rigid element comprises a plate member having an elongated body portion and an arm located centrally of said body portion and disposed substantially normal to said body portion, said first rigid element being connected to said arm of said second rigid element.

7. The apparatus of claim 6, wherein said body portion of said plate member includes at least one slot, and said housing includes pin members corresponding in number to the number of slots, said pin members being received in said slots and constraining movement of said plate member to linear motion.

8. The apparatus of claim 4, and further including speaker means for producing audible sound generated by said music producing means.

9. A music box, comprising:

a housing enclosing a power supply, a motor, a gear assembly coupled with said motor, and conductor means connecting said power supply and said motor, at least one platform means supported atop said housing for pivoting motion about a horizontal axis, each platform means capable of supporting a figurine, linkage means coupling said gear assembly and said at least one platform means, said linkage means being constrained for substantially linear, reciprocating, motion in a horizontal plane, said gear assembly including a rotary output shaft, a disk carried by said output shaft, a pin arranged eccentrically on said disk and engagable with one region of said linkage means for driving said linkage means in said substantially linear motion, said platform means including a depending element engaging a first portion of said linkage means so that back and forth motion of said linkage means pushes and pulls said depending element back and forth thereby imparting a rocking motion to the platform means, and hence the figurine mounted atop said platform means, and a pair of support arms associated with each of said platform means, said support arms being carried by said housing and being substantially vertically oriented, said platform means including laterally extending arms engagable with said support arms.

10. The music box of claim 9, wherein said housing includes a cover plate, and each pair of support arms is located at the periphery of an opening in said cover plate, said platform means being located on the opposite side of said cover plate from said linkage means.

11. The music box of claim 9, wherein said conductor means comprises a printed circuit board, said printed circuit board further supporting an IC component which generates sound and switch means for initiating said sound and operation of said motor.

12. The music box of claim 9, and further including speaker means.

13. The music box of claim 12, and further including conductor means coupling said speaker means with said power supply.

14. The music box of claim 11, wherein said switch means enables simultaneous operation of said IC component and motor.

15. The music box of claim 9, wherein said housing includes a cover having, for each said platform means, an opening in said cover communicating with said first portion of said linkage means, said linkage means first portion including means for securing said depending means of said platform means therein.

16. A music box, comprising:

a housing including a motor, gear apparatus coupled with said motor and defining an output axis, at least one platform means having a portion for supporting a figurine, said platform means being supported by said housing for pivoting motion about a horizontal axis, the horizontal axis and said output axis being arranged parallel to one another, said housing including a cover plate having an opening therethrough for receipt of each of said platform means, and a pair of arms disposed on opposite sides of the opening and extending outwardly of said housing away from said cover plate, said arms being arranged parallel to one another and directed normal to said output axis, each of said platform means including opposed arms configured for engagement by said pair of arms whereby each said platform means is supported by a respective one of said pair of arms for pivoting motion, and linkage means coupling said gear apparatus and said at least one platform means, said linkage means including a first rigid element interconnecting said gear apparatus with a second rigid element, where said second rigid element is coupled with each said platform means, said linkage means being constrained for substantially linear, reciprocating, motion.

* * * * *